United States Patent [19]

Keough et al.

[11] Patent Number: 4,949,774

[45] Date of Patent: Aug. 21, 1990

[54] EXPENDABLE CAP DEVICE TO MINIMIZE DROSS INCLUSIONS IN THE VACUUM CASTING PROCESS

[75] Inventors: John R. Keough; William R. Keough, both of Birmingham; Bela V. Kovacs, Bloomfield Hills, all of Mich.

[73] Assignee: Atmosphere Group, Livonia, Mich.

[21] Appl. No.: 329,392

[22] Filed: Mar. 27, 1989

[51] Int. Cl.[5] ..... B22D 18/06

[52] U.S. Cl. ..... 164/256; 164/134; 164/349; 164/63

[58] Field of Search ..... 164/134, 61, 63, 65, 164/253, 254, 255, 256, 257, 258

[56] References Cited

U.S. PATENT DOCUMENTS

| | | | |
|---|---|---|---|
| 2,248,868 | 7/1941 | Hanawalt | 164/256 |
| 4,658,880 | 4/1987 | Voss | 164/63 |

FOREIGN PATENT DOCUMENTS

| | | | |
|---|---|---|---|
| 59-45072 | 3/1984 | Japan | 164/63 |
| 62-3860 | 1/1987 | Japan | 164/256 |
| 63-149064 | 6/1988 | Japan | 164/63 |

*Primary Examiner*—Richard K. Seidel
*Attorney, Agent, or Firm*—Lynn E. Cargill

[57] ABSTRACT

A closed mold assembly having a mold cavity therein, an ingate extending from the mold cavity through the mold assembly with an opening having an outer wall for immersion into a bath of molten metal, and an expendable cap fitting around the outer wall of the ingate having a continuously upward tapering dimension to urge the top larger of the molten metal in a bath away from the ingate opening during the immersion process to minimize impurity inclusion in the mold. The expendable cap is preferably made from a non-contaminating sacrificial material intended to be melted after immersion into the molten metal bath without being detrimental to the quality of the workpiece. The closed mold assembly may also include upflow channels formed within the bottom of the mold assembly to further urge impurities in the top layer to flow away from the ingate opening and may further include downwardly extending ribs in the mold assembly with flat surfaces on the bottom to form a level surface to facilitate easy mold handling such that the molds may be stacked upon one another.

28 Claims, 2 Drawing Sheets

FIG 1
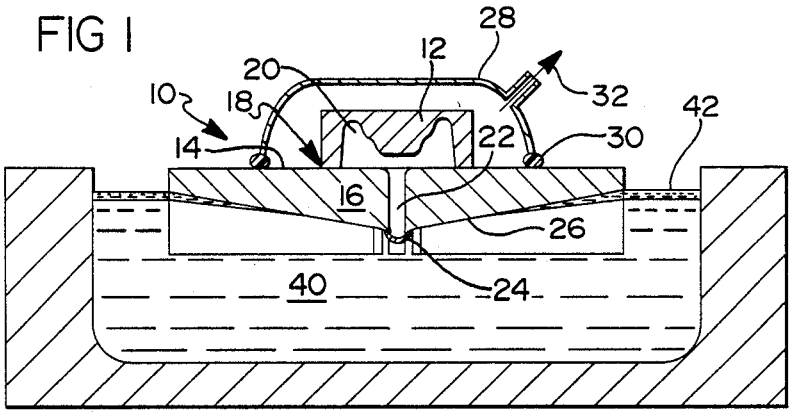
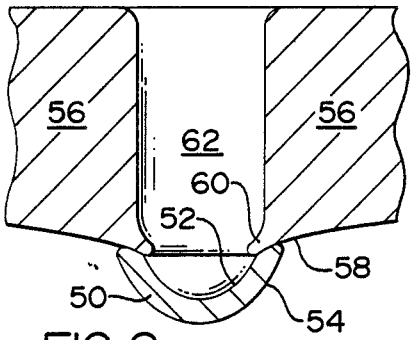
FIG 2
FIG 4
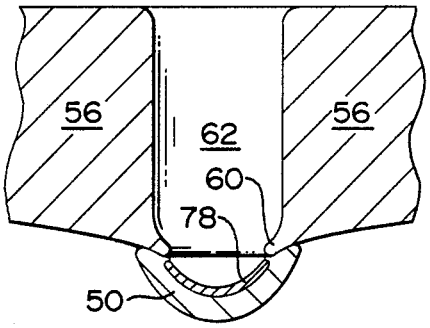
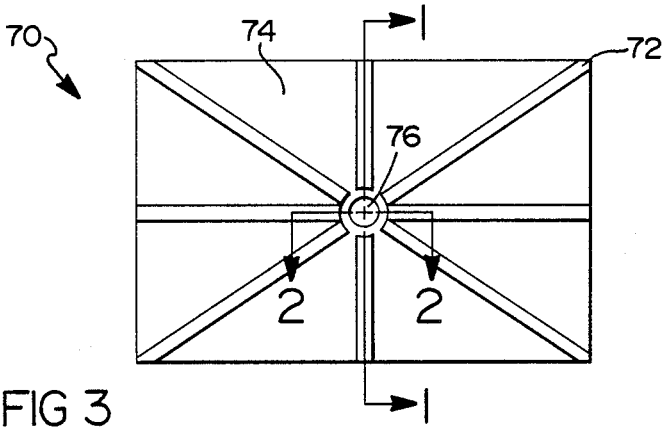
FIG 3

EXPENDABLE CAP DEVICE TO MINIMIZE DROSS INCLUSIONS IN THE VACUUM CASTING PROCESS

TECHNICAL FIELD

This invention relates in general to casting of workpieces, and more particularly relates to a mold for vacuum casting of thin walled metallic articles.

BACKGROUND OF THE INVENTION

It is well known in the art to cast metallic workpieces from a melt of molten metal in a bath by either drawing the melt up into the mold assembly by vacuum, or to pressurize the air space above the melt, thereby forcing the melt up into the mold. These casting techniques have many inherent porblems, including low numbers of production, low yield due to impurities, and slow production counts. Expensive equipment is currently being used to alleviate these problems. Attempts have been made to first vacuum refine the molten metal to remove impurities which may be incorporated into the molded article thereby increasing the yield. In order to speed up production, methods have been devised for continuous casting and for providing series of vacuum casting molds conveyed in seriatim through vacuum chambers located above baths of molten metal within furnaces. These attempts have met with a certain degree of success, although there is a great deal of room for improvement.

In conventional low pressure die casting, a die is arranged above a melt holding pot while a tube extends from inside the die to a location below the level of the melt. The melt is forced up into the mold by pressurizing the air space above the molten metal bath pot, thereby forcing the molten metal up the tube into the die cavity. Such a method is described in U.S. Pat. No. 3,842,893 issued Oct. 22, 1974 to Booth.

In an attempt to increase the yield of acceptable molded articles, devices for vacuum refining of molten metal have been proposed. Present art devices for the vacuum refining of molten metal generally comprise a vacuum chamber containing a vessel of molten metal. Such devices suffer from a low yield because only a surface metal layer is subjected to the vacuum treatment. High hydrostatic molten metal pressure forms gas bubbles at a considerable depth within the metal, thereby causing thermodynamic infeasibility. Such a device is disclosed in U.S. Pat. No. 4,014,529 issued Mar. 27, 1977 to Puzhailo et al. The main object of the '529 patent is to provide a device for the vacuum refining of molten metal to enhance the degree of metal refining to substantially reduce harmful impurities.

As currently practiced, vacuum molds include ingates extending from their bottom, while being connected to a vacuum source at the top. The terminal end of the ingate is dipped into a molten metal bath while vacuum is applied, and the molten metal is drawn up into the mold cavity through the ingate. When molding thin walled articles, the vacuum casting technique produces an unusually low yield of acceptable product because the impurities on the surface of the molten metals, commonly known as dross of slag, are drawn up into the mold before the pure metal within the molten bath is drawn in. Because the molten metal is at an elevated temperature in the bath, the surface metal chemically reacts with the oxygen in the air above the bath to form metallic oxides and other undesirable impurities. Certain methods of molding utilize inert gas atmospheres over the molten metal bath to reduce the formation of dross or slag. This method, however, is costly and requires additional equipment and gas sources.

In conventional open atmosphere methods, the terminal end of the ingate is dipped through the dross layer on top of the molten metal during immersion and the dross is drawn into the mold cavity along with the pure metal by the vacuum and produces thin walled articles with dross and other impurities incorporated into the workpiece. For most molded articles, and especially for ones in the automotive field, the thin walled molded articles which include dross and other impurities are unacceptable and must be scrapped. Because it is critical for most of the molded articles to have high material integrity, this yields low numbers of manufactured products.

One attempt to increase the purity of molten metal being upcast is described in U.S. Pat. No. 4,211,270 issued Jul. 8, 1980 to Shinopulos et al. Described therein is cooled "open" mold assembly for the continuous, high speed casting of metallic strands, especially for upcasting strands of copper alloys. An "open" mold is one in which melt is continuously fed through the mold and immediately chilled at the end of the mold to form a product. Shinopulos et al. describes a cone assembly attached to the terminal end of the die extending from the mold which is made of a material non-contaminating to the melt being cast. The cone is attached to the bottom of the die portion, such that when the die portion of the mold assembly is inserted into the melt, the cone covers the end of the die portion, piercing the dross on the surface of the melt as it is immersed to reduce the quantity of foreign particles caught in the die during the upcasting process. The melt dissolves the cone and a starter rod bolt pushes a second cone off the die so that it floats to the side. This structure and method is particularly suited for continuous casting of metallic strands through "open" molds at high speeds, and is used for a single insertion of the die portion into the molten metal in the bath. Thereafter, the continuous casting of metallic strands is maintained until either: (1) the molten metal in the bath is depeleted; or (2) sufficient metallic strands have been made to meet production schedules. This configuration is not particularly well suited for a closed mold assembly because closed molds cannot inlcude the starter rod bolt used in the open mold assembly. Therefore, different structures are required for a closed mold assembly.

Therefore, it is a primary object of the present invention to provide a closed mold assembly including an expendable cap for molding single articles and cast parts.

It is another object of the present invention to provide a closed mold assembly suitable for vacuum casting thin wall molded articles having reduced impurities contained therein.

It is yet another object of the present invention to provide a closed mold assembly with upflow channels on the bottom of the mold assembly including channeled ribs for urging dross and other impurities in the top layer of the molten metal away from the ingate so that the impurities in the top layer of the melt are not incorporated into the molded article.

SUMMARY OF THE INVENTION

In accordance with a preferred embodiment of the invention, these and other objects and advantages are addressed as follows. A mold assembly capable of producing high yield, relatively impurity-free vacuum cast articles is made of a closed mold having a mold cavity therein. The mold assembly has an ingate extending from the mold cavity through the mold assembly with a lower end extending below the bottom of the mold assembly. In the end of the ingate is an opening for immersion in a bath of molten metal. The upper end of the ingate terminates in the mold cavity. The lower end has an outer wall which surrounds the portion of the ingate extending below the bottom, and the outer wall has an upwardly and outwardly tapering shape to help urge the dross and impurities away from the opening after it is immersed into the bath.

An expendable cap is included on the mold assembly which has a size and shape sufficient to fit around the outer wall of the lower end of the ingate, with a tapering dimension continuously upward from its bottom to the point of attachment to the ingate lower end. The cap is designed without flat portions which might trap impurities and then be drawn into the mold. An upwardly and outwardly tapering surface is provided on the cap to urge impurities and dross on the top layer of the molten metal in the back away from the ingate opening during the immersion process to minimize impurity inclusion in the mold after it has been drawn up into the cavity.

It would be advantageous for the expandable cap to be made from a non-contaminating sacrificial material intended to be melted after immersion into the bath so that the material of the expendable cap may be incorporated into the molded article without being detrimental to the quality of the workpiece being molded. Materials which are substantially similar to the metal in the molten bath, high temperature plastics, or carbon-containing compounds are the preferred compositions for the cap, although various metals and other materials may be obvious to one skilled in the art.

The expendable cap may be formed into a conically shaped cap having a rounded tip, but may also be shaped as a cone, or a hemisphere or any other shape having an upwardly and outwardly tapering shape to urge dross away from the ingate opening. Preferably, the lower end of the ingate has a downwardly tapering dimension adapted to receive the inside of the expendable cap, thereby forming a light press fit around the outer wall of the ingate extension. This will aid in replacement of the expendable cap after the mold has been taken apart to ready it for another operation. Moreover, the expendable cap may be coated with an anti-adhesion material to further aid in urging the dross away from the ingate opening during immersion.

In another embodiment of the present invention, a closed mold assembly device including an ingate and an expendable cap further includes upflow channels formed within the bottom of the mold assembly to help urge impurities in the top layer of the molten metal bath to flow even further away from the ingate opening as the mold is immersed in the molten metal bath. The upflow channels preferably do not include any flat, horizontal portions capable of trapping dross which may then be later drawn up into the mold cavity.

In yet another embodiment of the present invention, a closed mold assembly device having the abovementioned elements may further inlcude downwardly extending ribs between the upflow channels having flat surfaces on the bottom to form a level, horizontal surface to facilitate easy mold handling such that the molds may be stacked upon one another. The aggregate horizontal surface area of the extended ribs is sufficiently small so that the dross will not be trapped thereunder.

BRIEF DESCRIPTION OF THE DRAWINGS

The nature and extent of the present invention will be clear from the following detailed description of the particular embodiments thereof taken in conjunction with the appendant claims, in which:

FIG. 1 shows a cross-sectional view of the inventive device constructed in accordance with the present invention, wherein the closed mold assembly is shown immersed within a molten metal bath;

FIG. 2 illustrates more detail of the expendable cap of the invention and the lower end of the ingate;

FIG. 3 is a bottom plan view of the mold assembly illustrating the respective placement of the expendable cap, the upflow channels, and the extended ribs for stacking; and FIG. 4 shows a second expendable cap formed within the first expendable cap.

DETAILED DESCRIPTION OF THE INVENTION

Referring first to FIG. 1, a closed mold assembly is generally denoted by the numeral 10. The closed mold assembly 10 includes an upper mold piece 12 having a mold cavity 20 therein which is atop the upper surface 14 of a lower mold assembly piece 16. Seam line 18 of the mold assembly is shown where the mold cavity 20 terminates. Ingate 22 extends from the mold cavity 20 through the lower mold piece 16 and has an expendable cap 24 fitted over the lower end of the ingate 22. The lower surface 26 of the lower mold piece is shown formed into an upflow channel configuration. A bell housing 28 is adapted to fit over the mold assembly 10 and is made air tight by O-rings 30. A vacuum source 32 applies a vacuum through the mold assembly as it is immersed into the molten metal bath 40. The top layer of the molten metal bath includes dross 42 or other impurities. As can be seen in FIG. 1, as the mold assembly is inserted into molten bath 40, dross 42 is urged away from the ingate opening due to the combined effect of the expendable cap 24 and the upflow channels formed in the lower surface 26 of the lower mold piece.

In operation, the closed mold assembly receives a bell housing or other air tight sealing means thereover. Vacuum is applied before immersion into the molten metallic bath. The upper mold piece is porous, so the vacuum is applied through the upper mold piece, the mold cavity and the ingate. The vacuum is not so great as to pull the expendable cap up into the ingate before it melts. The mold assembly is then dipped into the bath so that the seam line of the mold is above the upper surface of the bath. The expendable cap is made of a sufficient thickness to delay melting of the cap until the dross is urged far enough away from the ingate opening to substantially prevent dross from entering the ingate after the cap melts. Once the cap melts, the vacuum draws a portion of the bath into the ingate and up into the mold cavity, thereby molding a part. Because the melted cap material is drawn up into the mold cavity and therefore incorporated into the molded article, the cap must be made of a non-contaminating material. Likewise, the cap must resist immediate melting by either forming a sufficiently thick cap, or by adding materials to the cap, or caps if more than one or used, which slow the melting process due to their higher melting points.

Referring now to FIG. 2, a detailed illustration of the lower end of the ingate and the expendable cap is shown. The lower piece 56 of the mold assembly has a lower surface 58 which tapers upwardly and outwardly to form upflow channels. Ingate 62 has an extended portion 60 having an outer wall which is complimentary to inner wall 52 of expendable cap 50. The outer surface 54 of expendable cap 50 has a tapering dimension continuously upward from its bottom to the point of attachment to the ingate lower end extended portion 60. Preferably, there are no flat, horizontal portions on outer surface 54 which might trap impurities, thereby providing a continuous upwardly and outwardly tapering surface to urge the top layer of the molten metal in the bath away from the ingate opening during the immersion process to minimize impurity inclusion in the mold. Expendable cap 50 is preferably made from a non-contaminating, sacrificial material intended to melt after immersioon in the molten bath without detrimental effects to the quality of the workpiece being molded. Expendable cap 50 may be made of a material substantially similar to the metal material of the molten metal back, or it may include a high temperature plastic or a carbon-containing compound. Further in accordance with the present invention as shown in FIG. 4, a second expendable cap 78 may be formed within the first expendable cap, and the second cap may be made from a different material from the first cap.

The cap may be formed into a conically shaped cap having a rounded tip, but may also be made of a conically shaped cap or a hemispherical shape. Regardless of the shape, the expendable cap must have a dimension which is continuously tapering upward from its bottom to the point of attachment to the ingate lower end so that the dross is urged away from the opening of the ingate before the expendable cap melts. The ingate lower end extended portion 60 should have a downwardly tapering dimension which is adapted to receive the expendable cap, preferably forming a light press fit around the outer wall of the ingate extension. The expendable cap 50 may be coated with a non-contaminating anti-adhesion material to further aid in the urging of the dross away from the ingate opening.

Looking now to FIG. 3, a bottom plan view of the present invention is illustrated. The closed mold assembly is generally denoted by numeral 70, and includes upflow channels 74 and extended ribs 72. An expendable cap is shown as numeral 76. Extended ribs 72 are designed to facilitate handling of the mold assembly. A cross sectional view of ribs 72 is shown in FIG. 1 as taken along lines 1—1 of FIG. 3. Upflow channels 74 are recessed areas between ribs 72, acting to urge dross even further away from cap 76 so that dross is sufficiently removed from the area by the time the cap melts to assure that only pure metal is drawn up into the mold cavity. Although the ribs 72 are shown in a particular configuration, many different configurations are possible, as long as the intended purpose of providing a support means to stack and store the mold assembly without providing any surfaces to trap dross is fulfilled.

The upflow channels 74 are recessed within the bottom of the mold assembly to further urge impurities in the top layer of the molten metal back to flow away from the ingate lower end opening after the expendable cap has urged the dross away from its region. Downwardly extending ribs 72 generally have a relatively flat surface on their bottoms to form a flat horizontal surface to facilitate easy mold handling such that the molds may be stacked upon one another. Ribs 72 should not contain any flat regions or concave regions which would tend to trap dross impurities which may then be drawn into the ingate and consequently into the final molded product.

Thus, there is provided in accordance with the present invention, a closed mold assembly which is designed to substantially reduce the amount of dross or impurities included in the molded article.

While our invention has been described in terms of a few specific examples and configurations, it will be appreciated that other forms could readily be adapted by one skilled in the art. Accordingly, the scope of our invention is to be considered limited only by the following claims.

We claim:

1. A mold for casting workpieces, comprising:

a closed mold assembly having a mold cavity therein, said mold assembly having an ingate extending from the mold cavity through the mold assembly, said ingate having a lower end extending below the bottom of the mold assembly with an opening for immersion in the bath of molten metal and an upper end terminating in the mold cavity, said lower end of the ingate having an outer wall of the ingate surrounding the portion of the ingate extending below the bottom, and said outer wall of the ingate having an upwardly and outwardly tapering shape; and an expendable cap of a size and shape sufficient to fit around the outer wall of the lower end of the ingate, said expendable cap being formed into a conical shape having a pointed tip, thereby providing an upwardly and outwardly tapering surface to urge the top layer of the molten metal in the bath away from the ingate opening during the immersion process to minimize impurity inclusion in the mold, said expendable cap being made from a non-contaminating, sacrificial material intended to melt a desired time after immersion in said melt without being detrimental to the quality of the workpiece being molded.

2. A mold for casting workpieces, comprising:

a closed mold assembly having a mold cavity therein, said mold assembly having an ingate extending from the mold cavity through the mold assembly, said ingate having a lower end extending below the bottom of the mold assembly with an opening for immersion in the bath of molten metal and an upper end terminating in the mold cavity, said lower end of the ingate having an outer wall of the ingate surrounding the portion of the ingate extending below the bottom, and said outer wall of the ingate having an upwardly and outwardly tapering shape; and an expendable cap of a size and shape sufficient to fit around the outer wall of the lower end of the ingate, said expendable cap being formed into a conical shape having a rounded tip, thereby providing an upwardly and outwardly tapering surface to urge the top layer of the molten metal in the bath away from the ingate opening during the immersion process to minimize impurity inclusion in the mold, said expendable cap being made from a non-contaminating, sacrificial material intended to melt a desired time after immersion in said melt without being detrimental to the quality of the workpiece being molded.

3. A mold for casting workpieces, comprising:

a closed mold assembly having a mold cavity therein, said mold assembly having an ingate extending from the mold cavity through the mold assembly, said ingate having a lower end extending below the bottom of the mold assembly with an opening for immersion in the bath of molten metal and an upper end terminating in the mold cavity, said lower end of the ingate having an outer wall surrounding the portion of the ingate extending below the bottom, and said outer wall of the ingate having an upwardly and outwardly tapering shape;

an expendable cap of a size and shape sufficient to fit around the outer wall of the lower end of the ingate, said expendable cap being formed into a hemispherical shape, thereby providing an upwardly and outwardly tapering surface to urge the top layer of the molten metal in the bath away from the ingate opening during the immersion process to minimize impurity inlcusion in the mold, said expendable cap being made from a non-contaminating, sacrificial material intended to melt a desired time after immersion in said melt without being detrimental to the quality of the workpiece being molded.

4. A mold 1, wherein said cap is coated for casting workpieces, comprising:

a closed mold assembly having a mold cavity therein, said mold assembly having an ingate extending from the mold cavity through the mold assembly, said ingate having a lower end extending below the bottom of the mold assembly with an opening for immersion in the bath of molten metal and an upper end terminating in the mold cavity, said lower end of the ingate having an outer wall surrounding the portion of the ingate extending below the bottom , and said outer wall of the ingate having an upwardly and outwardly tapering shape; and an expendable cap of a size and shape sufficient to fit around the outer wall of the lower end of the ingate, said expendable cap having a dimension tapering continuously upward from its bottom to the point of attachment to the ingate lower end without any flat portions which might trap impurities and having a coating of an anti-adhesion material on the outside surface, thereby providing an anti-adhesive upwardly and outwardly tapering surface to urge the top layer of the molten metal in the bath away from the ingate opening during the immersion process to minimize impurity inclusion in the mold; said expendable cap being made from a non-contaminating, sacrificial material intended to melt a desired time after immersion in said melt without being detrimental to the quality of the workpiece being molded.

5. A mold for vacuum casting metallic parts, comprising:

a closed mold assembly having a mold cavity therein;

an ingate within said mold assembly having an upper and a lower end, the upper end of the ingate extending upwardly into the mold cavity, while the lower end of the ingate extends below the bottom of the mold assembly and includes an opening adapted for being immersed into a bath of molten metal, said opening being capable of channeling the molten metal therethrough and said lower end having an outer wall surrounding the portion of the ingate extending below the bottom and said outer wall having an upwardly and outwardly tapering shape;

an expendable cap of a size and shape sufficient to fit around the outer wall of the lower end of the ingate, said expendable cap having a dimension tapering continuously upward from its bottom to the point of attachment to the ingate lower end without any flat portions which might trap impurities, thereby providing an upwardly and outwardly tapering surface to urge the top layer of the molten metal in the bath away from the ingate opening during the immersion process to minimize impurity inclusion in the mold;

said expendable cap being made from a non-contaminating, sacrificial material intended to melt after immersion in said melt without being detrimental to the quality of the workpiece being molded; and upflow channels formed within the bottom of the mold assembly to further urge impurities in the top layer of the molten metal bath to flow up away from the ingate lower end opening as the mold is immersed in the molten metal bath.

6. The mold of claim 5, further comprising a second expendable cap formed within the first expendable cap.

7. The mold of claim 5, wherein said expendable cap is made of a material substantially similar to the material in the molten metal bath.

8. The mold of claim 5, wherein said expendable cap is made of a high temperature plastic material.

9. The mold of claim 5, wherein said expendable cap is made from a carbon-containing compound.

10. The mold of claim 5, wherein said expendable cap is formed into a conically shaped cap.

11. The mold of claim 5, wherein said expendable cap is formed into a conically shaped cap having a rounded tip.

12. The mold of claim 5, wherein said expendable cap is formed into a hemispherical shape.

13. The mold of claim 5, wherein said ingate lower end has a downwardly tapering dimension adapted to receive the expendable cap to form a light press fit around the outer wall of the ingate extension.

14. The mold of claim 5, wherein said expendable cap is coated with an anti-adhesion material to aid in the urging of the dross away from the ingate opening.

15. The mold of claim 5, wherein the mold assembly is made of a porous material such that when a vacuum is applied through the mold assembly, molten metal is drawn up into the mold cavity to form the workpiece.

16. A mold for vacuum casting metallic parts, comprising:

a closed mold assembly including a mold cavity therein;

an ingate within said mold assembly having an upper and a lower end, the upper end of the ingate extending upwardly into the mold cavity, while the lower end of the ingate extends below the bottom of the mold assembly and includes an opening adapted for being immersed into a bath of molten metal, said opening being capable of channeling the molten metal therethrough and said lower end having an outer wall surrounding the portion of the ingate extending below the bottom and said outer wall having an upwardly and outwardly tapering shape;

an expendable cap of a size and shape sufficient to fit around the outer wall of the lower end of the ingate, said expendable cap having a dimension tapering continuously upward from its bottom to the point of attachment to the ingate lower end without any flat portions which might trap impurities, thereby providing an upwardly and outwardly tapering surface to urge the top layer of the molten metal in the bath away from the ingate opening during the immersion process to minimize impurity inclusion in the mold;

said expendable cap being made from a non-contaminating, sacrificial material intended to melt after immersion in said melt without being detrimental to the quality of the workpiece being molded;

upflow channels formed within the bottom of the mold assembly to further urge impurities in the top layer of the molten metal bath to flow up away from the ingate lower end opening as the mold is immersed in the molten metal bath; and said mold assembly including downwardly extending ribs between the upflow channels having substantially flat surfaces on their bottoms to form flat, horizontal surfaces to facilitate easy mold handling such that the molds may be stacked upon one another.

17. The mold of claim 16, further comprising a second expendable cap formed within the first expendable cap.

18. The mold of claim 16, wherein said expendable cap is made of a material substantially similar to the material of the molten metal bath.

19. The mold of claim 16, wherein said expendable cap is made of a high temperature plastic material.

20. The mold of claim 16, wherein said expendable cap is made from a carbon-containing compound.

21. The mold of claim 16, wherein said expendable cap is formed into a conically shaped cap.

22. The mold of claim 16, wherein said expendable cap is formed into a conically shaped cap having a rounded tip.

23. The mold of claim 16, wherein said expendable cap is formed into a hemispherical shape.

24. The mold of claim 16, wherein said ingate lower end has a downwardly tapering dimension adapted to receive the expendable cap to form a light press fit around the outer wall of the ingate extension.

25. The mold of claim 16, wherein said expendable cap is coated with an anti-adhesion material to aid in the urging of the dross away from the ingate opening.

26. The mold of claim 16, further comprising indentations on the top of the mold assembly for receiving a bell housing adapted for applying a vacuum.

27. The mold of claim 16, wherein the mold assembly is made of a porous material such that when a vacuum is applied through the mold assembly, molten metal is drawn up into the mold cavity to form the workpiece.

28. A mold for vacuum casting metallic parts, comprising:

a two-piece closed mold assembly having an upper and a lower mold piece joined at a substantially horizontally oriented seal line, said upper mold piece being made of a suitable porous material so that a vacuum may be drawn through the mold assembly, and said upper mold piece including a mold cavity therein;

an ingate within said lower piece of the mold assembly having an upper and a lower end, the upper end of the ingate extending upwardly beyond the seam line into the mold cavity in the upper mold piece, while the lower end of the ingate extends below the bottom of the lower piece of the mold assembly and includes an opening adapted for drawing melt from a bath of molten metal;

said lower ingate end having a sloping outer wall surrounding the portion of the ingate extending below the bottom of the mold assembly and said sloping outer wall having an upwardly and downwardly tapering shape;

an expendable cap of a size and shape sufficient to fit around the outer wall of the lower end of the ingate, said expendable cap having a dimension tapering continuously upward from its bottom to the point of attachment to the ingate lower end without any flat portions which might trap impurities, thereby providing an upwardly and outwardly tapering surface to urge the top layer of the molten metal in the bath away from the ingate opening during the immersion process to minimize impurity inclusion in the mold;

said expendable cap being made from a non-contaminating, sacrificial material intended to melt after immersion in said melt without being detrimental to the quality of the workpiece being molded;

upflow channels formed within the bottom of the mold assembly to further urge impurities in the top layer of the molten metal bath to flow up away from the ingate lower end opening as the mold is immersed in the molten metal bath; and downwardly extending ribs formed in the lower mold piece between the upflow channels, said ribs having substantially flat surfaces on their bottoms to form a flat, level surface to facilitate easy mold handling such that the molds may be stacked upon one another.

* * * * *

UNITED STATES PATENT AND TRADEMARK OFFICE

CERTIFICATE OF CORRECTION

PATENT NO. : 4,949,774

DATED : August 21, 1990

INVENTOR(S) : John R. Keough et al.

It is certified that error appears in the above—identified patent and that said Letters Patent is hereby corrected as shown below:

ON THE TITLE PAGE:

In the Abstract, column 1, line 7, "larger" should be --layer--;

Column 1, line 17, "porblems" should be --problems--;

Column 2, line 23, after "is", insert --a--;

Column 5, line 3, "or" (second occurrence) should be --are--;

Column 5, line 23, "immersioon" should be --immersion--;

Column 7, line 30, claim 4, delete "1, wherein said cap is coated";

Column 10, line 12, claim 35, "seal" should be --seam--; and

UNITED STATES PATENT AND TRADEMARK OFFICE

CERTIFICATE OF CORRECTION

PATENT NO. : 4,949,774

DATED : August 21, 1990

INVENTOR(S) : John R. Keough et al.

It is certified that error appears in the above-identified patent and that said Letters Patent is hereby corrected as shown below:

Column 10, lines 28-29,
"downwardly" should be --outwardly--.

Signed and Sealed this

Sixteenth Day of June, 1992

*Attest:*

*Attesting Officer*

DOUGLAS B. COMER

*Acting Commissioner of Patents and Trademarks*